US006848145B2

(12) United States Patent
Lee et al.

(10) Patent No.: US 6,848,145 B2
(45) Date of Patent: Feb. 1, 2005

(54) STEAM JET APPARATUS FOR A VACUUM CLEANER

(75) Inventors: Hyun-ju Lee, Jeonju (KR); Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 322 days.

(21) Appl. No.: 10/241,467

(22) Filed: Sep. 12, 2002

(65) Prior Publication Data

US 2003/0159234 A1 Aug. 28, 2003

(30) Foreign Application Priority Data

Feb. 28, 2002 (KR) ..... 2002-10732

(51) Int. Cl.[7] ..... A47L 7/00; A47L 9/00

(52) U.S. Cl. ..... 15/322; 15/344

(58) Field of Search ..... 15/320, 321, 322, 15/344; 392/394, 403, 404

(56) References Cited

U.S. PATENT DOCUMENTS 1,783,610 A * 12/1930 Edmund ..... 132/212
2,259,545 A * 10/1941 Black ..... 134/57 R
2,818,485 A * 12/1957 Mantell ..... 392/403
3,719,795 A * 3/1973 Bolomier et al. ..... 392/404
4,759,719 A * 7/1988 Levenson ..... 434/300
5,059,287 A * 10/1991 Harkey, Sr. ..... 203/1
6,361,752 B1 * 3/2002 Demarest et al. ..... 422/306
6,477,890 B1 * 11/2002 Hulsebus ..... 73/40.7

FOREIGN PATENT DOCUMENTS

| | | | |
|---|---|---|---|
| DE | 29617784 | * | 2/1997 |
| EP | 0684006 | A1 | 11/1995 |
| JP | 02-082928 | | 3/1990 |
| JP | 7-275 166 | | 10/1995 |
| JP | 07-275166 | | 10/1995 |

* cited by examiner

*Primary Examiner*—Terrence R. Till
(74) *Attorney, Agent, or Firm*—Plumsea Law Group, LLC

(57) ABSTRACT

A steam jet apparatus of a vacuum cleaner removably mounted to a handle of a vacuum cleaner body to supply a jet of steam to a cleaning surface, and employs the power supply terminal and switch for the vacuum's attachment accessories. The steam jet apparatus includes a body having a reservoir; a steam generation device in the reservoir; a steam jetting nozzle disposed at one end of the body; and a connection structure disposed at the other end of the body to removably attach the apparatus to the handle. The connection structure has a power terminal to connect to the power supply terminal of the handle and the steam generation device. The reservoir and steam jetting nozzle are interconnected by a steam pathway which can be a pipe or a plurality of opposingly placed barricades in the reservoir.

14 Claims, 3 Drawing Sheets

STEAM JET APPARATUS FOR A VACUUM CLEANER

BACKGROUND OF THE INVENTION

1. Field of the Invention

The present invention relates to a steam jet apparatus of a vacuum cleaner, and more particularly, to a steam jet apparatus of a vacuum cleaner which is separable and can be selectively attached to the handle of the cleaner.

2. Description of the Prior Art

Generally, a vacuum cleaner has a cleaner body having a driving motor to generate a suction force, a suction extension pipe connected with the cleaner body, and a suction brush installed at one end of the suction extension pipe in order to draw in dust from a cleaning surface. A handle with an on/off switch is usually disposed at one end of a suction extension pipe. Moreover, the suction extension pipe with a suction brush has a structure to be connected to and separated from the handle, thus a user can easily clean corners and other confined areas of the cleaning surface by manipulating the handle.

In the meantime, when the user cleans with the vacuum cleaner having the above construction, dust and other substances are drawn into the cleaner body by being drawn with air through a suction brush attachment. However, stains or microbes on cleaning surfaces such as floors, carpets, furniture, drapes and other such surfaces are not easily removed by vacuum power alone.

Providing a jet of steam is a widely known way of facilitating removal of such stubborn stains or microbes, and accordingly, many attempts have been made to develop a vacuum cleaner having a reliable and user-friendly steam jet apparatus.

SUMMARY OF THE INVENTION

It is an object of the present invention to provide a steam jet apparatus for a vacuum cleaner, which can be selectively attached to a handle of the cleaner as needed during cleaning.

The above object of the present invention is realized by providing a steam jet apparatus of a vacuum cleaner which is removably installed to the handle. The handle of the vacuum cleaner includes a power supply terminal and is disposed at an end of a suction extension pipe which is, in turn, connected to the cleaner body. The steam jet apparatus is an attachment accessory similar to a suction brush, and is designed to employ the power supply terminal that a suction brush attachment would use. The steam jet apparatus includes a body having a reservoir to contain water; a steam generation device disposed in the reservoir; a steam jetting nozzle disposed at an end of the body to jet the generated steam; and a connection portion disposed at one side of the body and removably connected to the handle. The connection portion includes both attachment structure for the steam jet apparatus accessory and a power terminal to connect with the power supply terminal of the handle to thereby power the steam generation device.

The steam jet apparatus also includes a heater disposed in the reservoir to generate steam from the water when heated. The invention also includes a steam pathway to move the steam generated at the heater by connecting the heater to the steam jetting nozzle. The pathway can be a pipe or a path formed by opposingly placed barriers which contain water within the reservoir but allow steam to exit. The steam generation device may be any type of heater device or a pair of carbon bars driven by the power supplied through the power terminal. The carbon bars are disposed in the reservoir so that a predetermined part thereof is in contact with the water stored therein.

Additionally, the connection portion includes a connection protrusion which can be inserted into a mating end of an air suction port of the handle in order to close off the air suction port, and a contact portion having a shape corresponding to a lower end of the handle to support the apparatus thereon.

BRIEF DESCRIPTION OF THE DRAWINGS

The above-mentioned object and the feature of the present invention will be more apparent by describing the preferred embodiments of the present invention by referring to the appended drawings, in which.

DESCRIPTION OF THE PREFERRED EMBODIMENTS

Figure 1:
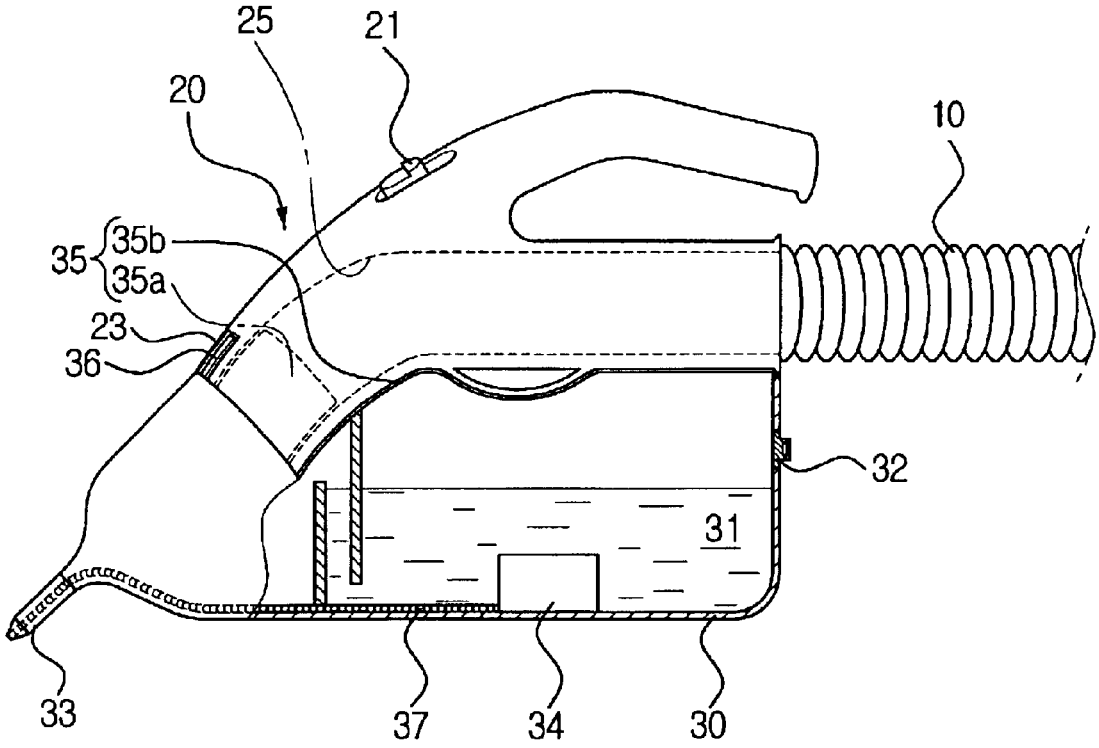
FIG. 1 is a partial sectional view schematically showing a steam jet apparatus of a vacuum cleaner according to a preferred embodiment of the present invention.

Referring to FIG. 1, the steam jet apparatus of a vacuum cleaner according to a preferred embodiment of the present invention is removably mounted on a handle 20 which is connected to an air suction pipe 10 that is in turn connected to a vacuum cleaner body (not shown). The steam jet apparatus comprises a body 30 having a reservoir 31 to contain water therein, a steam generation device disposed in the reservoir 31 to generate steam, a steam jetting nozzle 33 disposed at an end of the body 30 to jet the generated steam to a desired cleaning surface, and a connection portion 35 that includes structure for attaching the body 30 to handle 20.

One type of widely used attachment accessory that is removably connected to handle 20 is a vacuum extension pipe connected with a vacuum brush The brush is generally a rotating brush which is powered by connection to a power supply terminal 23 that is coupled to a separate a power switch disposed on handle 20. The steam jet apparatus of the present invention is designed as another attachment accessory which employs the power supply terminal and power switch on handle 20 to power the steam generating device. One end of the steam jet apparatus is a steam nozzle, adjacent the handle connection, and the other end integrates the reservoir. A lid 32 is provided on body 30 in order to selectively open or cover a water supply port used to fill water in reservoir 31. Reservoir 31 has a capacity of about 300 cc of water, and the steam generation device is integrated therein, preferably at the bottom of the reservoir.

One embodiment of the steam generation device is an immersible heater 34 driven by electrical power supplied through the power supply terminal 23. When actuated, heater 34 generates steam from the water in reservoir 31. To accomplish steam generation, when the steam jet apparatus is connected to handle 20 by engagement of the connection portion 35 with the air suction port of the vacuum cleaner, a power terminal 36 of the steam jet apparatus electrically connects to power supply terminal 23 to enable switch 21 to provide power to the steam generation device arranged proximate heater 34 is a steam pipe 37 formed with body 30 to permit the steam to flow to the jetting nozzle 33. In this embodiment, the heater is immersible and is shown to be disposed along the bottom wall of the reservoir. The heater heats water in its immediate vicinity to provide the resulting steam to steam pipe 37. One end of steam pipe 37 is connected to the heater 34 and the other end is connected to the jetting nozzle 33.

Figure 2:
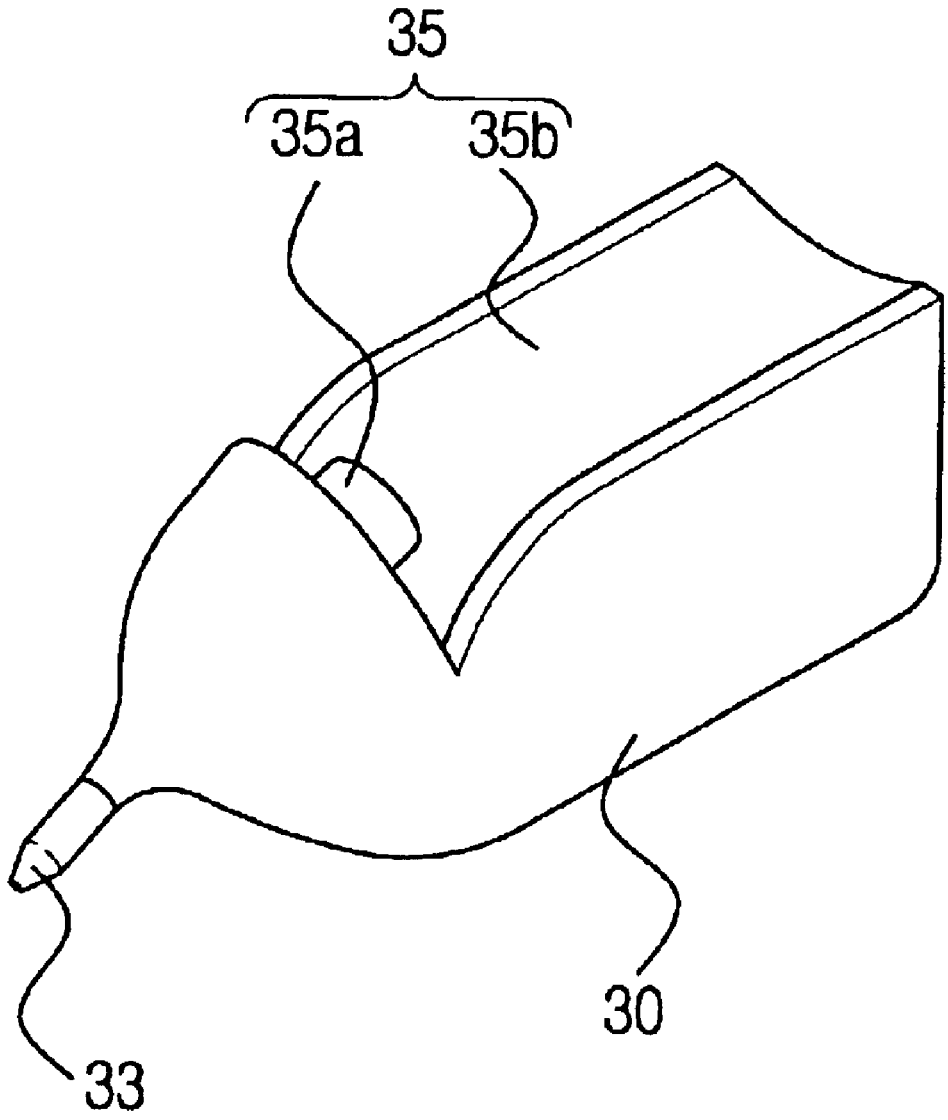
FIG. 2 is a perspective view schematically showing a steam jet apparatus of FIG. 1.

The connection portion 35 includes the structural and electrical connection features to attach the steam jet apparatus to the handle 20. As shown in FIG. 2, the connection portion 35 has connection protrusion 35*a* which is inserted into air suction port 25 disposed at a front end of the handle 20, and a contact support portion 35*b* corresponding in shape to a lower part of the handle 20. The connection protrusion 35*a* is sized and configured to matingly engage by force-fit the air suction port 25 of the handle 20. Therefore, the connection protrusion 35*a* serves the dual functions of blocking the vacuum in the air suction port 25 and connecting the steam jet apparatus to the handle 20. The contact support portion 35*b* is formed as a predetermined shape corresponding to the shape of the lower part of the handle 20 in order to abut and support the structure by contact.

Figure 3:
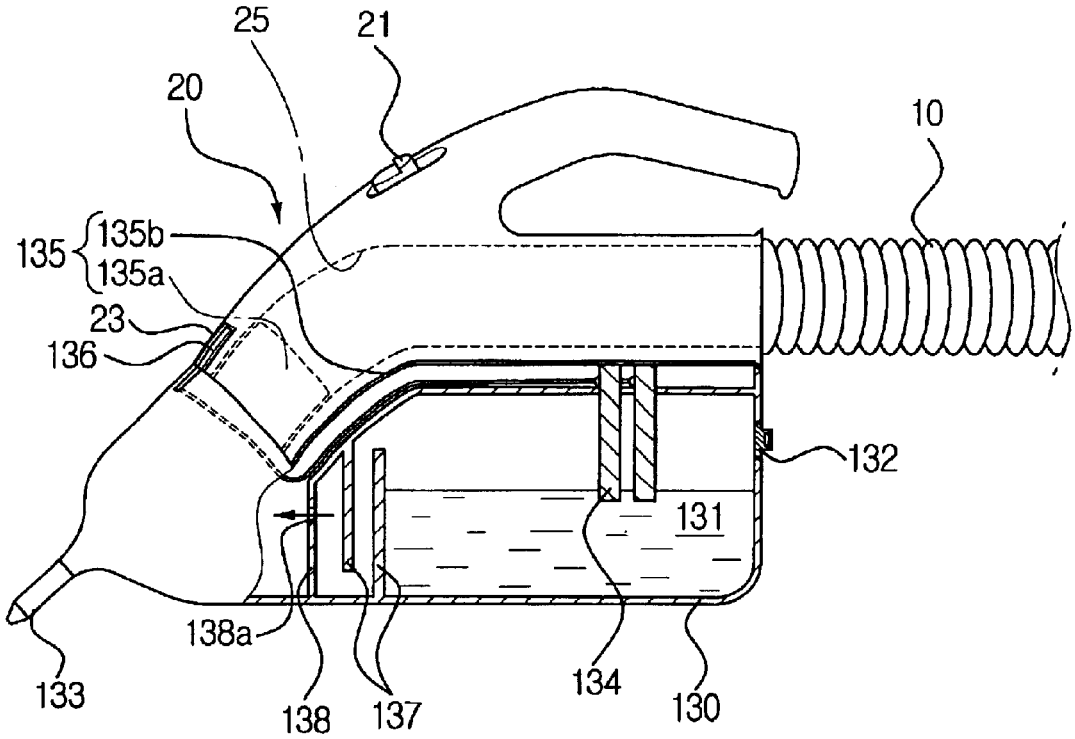
FIG. 3 is a partial sectional view schematically showing a steam jet apparatus of a vacuum cleaner according to another preferred embodiment of the present invention.

FIG. 3 is a partial view schematically showing a steam jet apparatus of a vacuum cleaner according to another preferred embodiment of the present invention. Similar to the previous embodiment, the steam jet apparatus of FIG. 3 comprises a body 130 having a reservoir 131 to store water therein, a steam jetting nozzle 133 disposed at one side of the body 130, a steam generation device disposed in reservoir 131, and a connection structure 135. Connection structure 135 has a connection protrusion 135*a* and a contact support portion 135*b* identical to the steam jet apparatus of FIGS. 1–2. In addition, a power terminal 136 of the attachment is adapted to connect to the power supply terminal 23 of the handle 20.

In the embodiment of FIG. 3, the steam generation device comprises a pair of carbon bars 134 affixed within reservoir 131. In this embodiment, the carbon bars are shown to be disposed along a top wall of the reservoir so that only a predetermined length of each bar is in contact with the water therein. The carbon bars 134 are electrically connected with power terminal 136, and generate steam by being driven by power supplied through the power terminal 136. The carbon bars 134 are advantageous over other types of heating devices in that they can generate steam quickly and are light-weight.

A plurality of partitions 137 and 138 are provided in body 130 to prevent water from moving between reservoir 131 and steam jetting nozzle 133. The partitions 137 and 138 are attached in turn on opposing sides of reservoir 131 to form a steam pathway. Therefore, while water in reservoir 131 is blocked from entering steam jetting nozzle 133 by opposing partitions 137 and 138, the steam generated in reservoir 131 moves through the steam pathway formed thereby. In addition, the partition 138 has an aperture 138*a* formed therein at a predetermined height to allow the steam passing through the partitions 137 and 138 to exit. In this manner, the steam generated in reservoir 131 is fed to the steam jetting nozzle 133 to provide a jet of steam to the cleaning surface outside of the apparatus. A steam generation apparatus having the structures described above can generate steam from a small amount of water, and accordingly, the vacuum cleaner can be kept both compact and light-weight. Moreover, with the streamlined structure, the steam jet apparatus can be selectively mounted to the handle with a simple manipulation as needed enabling the user to use the vacuum cleaner easily and more conveniently.

In addition, since the steam jet apparatus is installed as an accessory attached to the handle, it may be offered as a separate accessory keeping the cost of the vacuum cleaner relatively low. This separate accessory also provides more flexibility for the end user. Although this invention has been described with reference to steam generated by water, it is within the scope of the invention to use any suitable fluid such as a cleaning solution or water mixed with a desired solvent.

Although the preferred embodiments of the present invention have been described, it will be understood by those skilled in the art that the present invention should not be limited to the described preferred embodiments, but various changes and modifications can be made within the spirit and the scope of the present invention. Accordingly, the scope of the present invention is not limited within the described range but the following claims.

What is claimed is:

1. A steam jet apparatus of a vacuum cleaner removably mounted to a handle having a power supply terminal and switch therefor, the handle being disposed at a suction extension pipe connected to a vacuum cleaner body, the steam jet apparatus comprising:

a body having a reservoir to store a fluid;

a steam generation device provided in the reservoir, to generate steam from the stored fluid;

a steam jetting nozzle coupled to the steam generation device and disposed at one end of the body to jet resulting steam; and a connection structure at an opposite end of the body for removably attaching the apparatus to the handle, the connection structure including a power terminal connected to the steam generation device and also adapted to connect to the power supply terminal of the handle.

2. The steam jet apparatus of claim 1, wherein the steam generation device includes a heater disposed in the reservoir and connected to the power terminal.

3. The steam jet apparatus of claim 2, further comprising a steam pipe connecting the heater and the steam jetting nozzle to convey the steam generated at the heater to the nozzle.

4. The steam jet apparatus of claim 1, wherein the steam generation device includes a pair of carbon bars coupled to the power terminal and adapted to be driven by the power supply, the carbon bars disposed in the reservoir so that a predetermined portion thereof is immersed in the water stored therein.

5. The steam jet apparatus of claim 4, further comprising a plurality of partitions provided on opposing sides of the reservoir to form a steam pathway to facilitate movement of steam from the reservoir to the steam jetting nozzle while preventing movement of water stored in the reservoir.

6. The steam jet apparatus of claim 1, wherein the connection structure includes a connection protrusion protruded from the body and adapted to be inserted into an air suction port of the handle to thereby close the air suction port, and a contact portion adapted to have a shape corresponding to a lower end of the handle to abut thereagainst.

7. A vacuum cleaner attachment accessory for providing steam to a cleaning surface, said accessory adapted to attach to a handle of the vacuum cleaner, and having an integrated body comprising:

a connection structure adapted to attach to the handle of the vacuum cleaner, and including an electrical terminal adapted to couple to a power supply on the handle;

a reservoir for containing a liquid therein;

a steam nozzle in fluid communication with said reservoir via a steam pathway for releasing steam to the cleaning surface; and a steam generation device disposed in said reservoir and electrically coupled to said electrical terminal to heat the fluid in said reservoir and thereby generate steam.

8. The vacuum cleaner accessory of claim 7, wherein said steam pathway is a pipe extending from said reservoir to said steam nozzle.

9. The vacuum cleaner accessory of claim 8, wherein said steam generation device is an immersible heater coupled to said pipe.

10. The vacuum cleaner accessory of claim 7, wherein said steam pathway is formed of a plurality of opposingly arranged barricades within said reservoir to contain liquid but allow exit of steam through said steam nozzle.

11. The vacuum cleaner accessory of claim 10, wherein said steam generation device comprises a pair of carbon bars in electrical communication with said electrical terminal.

12. The vacuum cleaner accessory of claim 7, wherein said steam generation device is an immersible heater.

13. The vacuum cleaner accessory of claim 7, wherein said steam generation device comprises a pair of carbon bars in electrical communication with said electrical terminal.

14. The vacuum cleaner accessory of claim 7, wherein said connection structure comprises an integral protrusion formed on said body, said protrusion configured to be inserted into a mating socket of the vacuum cleaner.

* * * * *